United States Patent [19]

White

[11] 4,010,725

[45] Mar. 8, 1977

[54] SELF-CONTAINED ENGINE WARMER

[76] Inventor: Cygnal G. White, 4835 Read Blvd., New Orleans, La. 70127

[22] Filed: Nov. 14, 1974

[21] Appl. No.: 523,679

[52] U.S. Cl. ..... 123/142.5 R; 123/122 R; 123/179 H

[51] Int. Cl.² ..... F02N 17/02

[58] Field of Search ..... 123/179 H, 142.5 R, 123/122 R

[56] References Cited

UNITED STATES PATENTS

| | | | |
|---|---|---|---|
| 2,389,925 | 11/1945 | Morgan et al. | 123/142.5 R |
| 2,712,815 | 7/1955 | Blessing | 123/142.5 R |
| 2,721,544 | 10/1955 | Kimberlin | 123/142.5 R |
| 3,159,153 | 12/1964 | Thomas | 123/142.5 R |
| 3,209,123 | 9/1965 | Windsor | 123/142.5 R |
| 3,213,263 | 10/1965 | Steenbergen | 123/142.5 R |
| 3,218,433 | 11/1965 | Steenbergen | 123/142.5 R |
| 3,249,737 | 5/1966 | Casebeer | 123/142.5 R |
| 3,400,700 | 9/1968 | Lindsey et al. | 123/142.5 R |

FOREIGN PATENTS OR APPLICATIONS

| | | | |
|---|---|---|---|
| 244,000 | 5/1969 | U.S.S.R. | 123/142.5 |

*Primary Examiner*—C. J. Husar
*Assistant Examiner*—Paul Devinsky
*Attorney, Agent, or Firm*—Harness, Dickey & Pierce

[57] ABSTRACT

A self-contained device for preheating or maintaining a predetermined heat in an internal combustion engine. The device includes a so-called infrared burner that is adapted to be positioned in heat exchanging relationship with a portion of the engine, a fuel source for the burner, and an ignition source for igniting the burner. The ignition source is adapted to be suitably powered, for example, by the battery of the associated engine.

2 Claims, 4 Drawing Figures

SELF-CONTAINED ENGINE WARMER

BACKGROUND OF THE INVENTION

This invention is adapted to be embodied in a self-contained system for heating or warming an internal combustion engine.

As is well known, internal combustion engines do not operate efficiently at temperatures considerably lower than their design operating temperature. Starting at such low temperature conditions is difficult with cold oil due to the increased viscosity and difficulties encountered in cranking. In addition, the cold intake manifold and cylinder walls cause condensation of the fuel in these areas resulting in poor efficiency and difficulties in starting. Various devices have been proposed for preheating internal combustion engines of both the Diesel and spark-ignition type. For the most part, these devices have required external sources of energy, such as the well-known head-bolt or dipstick-immersion type electrical heaters which require external sources of electrical energy. Alternatively, it has been proposed to embody large gas-fired burners for heating the entire exterior of the engine. Such devices are, obviously, cumbersome and present fire hazards.

It is, therefore, a principal object of this invention to provide an improved engine heater.

It is another object of the invention to provide an improved, self-contained engine heater that requires no external sources of energy or power.

It is yet another object of the invention to provide a compact, highly efficient self-contained engine heater.

SUMMARY OF THE INVENTION

This invention is adapted to be embodied in a self-contained heating system for an internal combustion engine. The heating system comprises a burner that is adapted to be mounted in heat exchanging relationship with a portion of the engine. A fuel source is provided for supplying fuel to the burner. An electrical ignition system is also provided for igniting the burner and which is capable of being fired by the battery of the associated engine.

DETAILED DESCRIPTION OF THE PREFERRED EMBODIMENT

Figure 1:
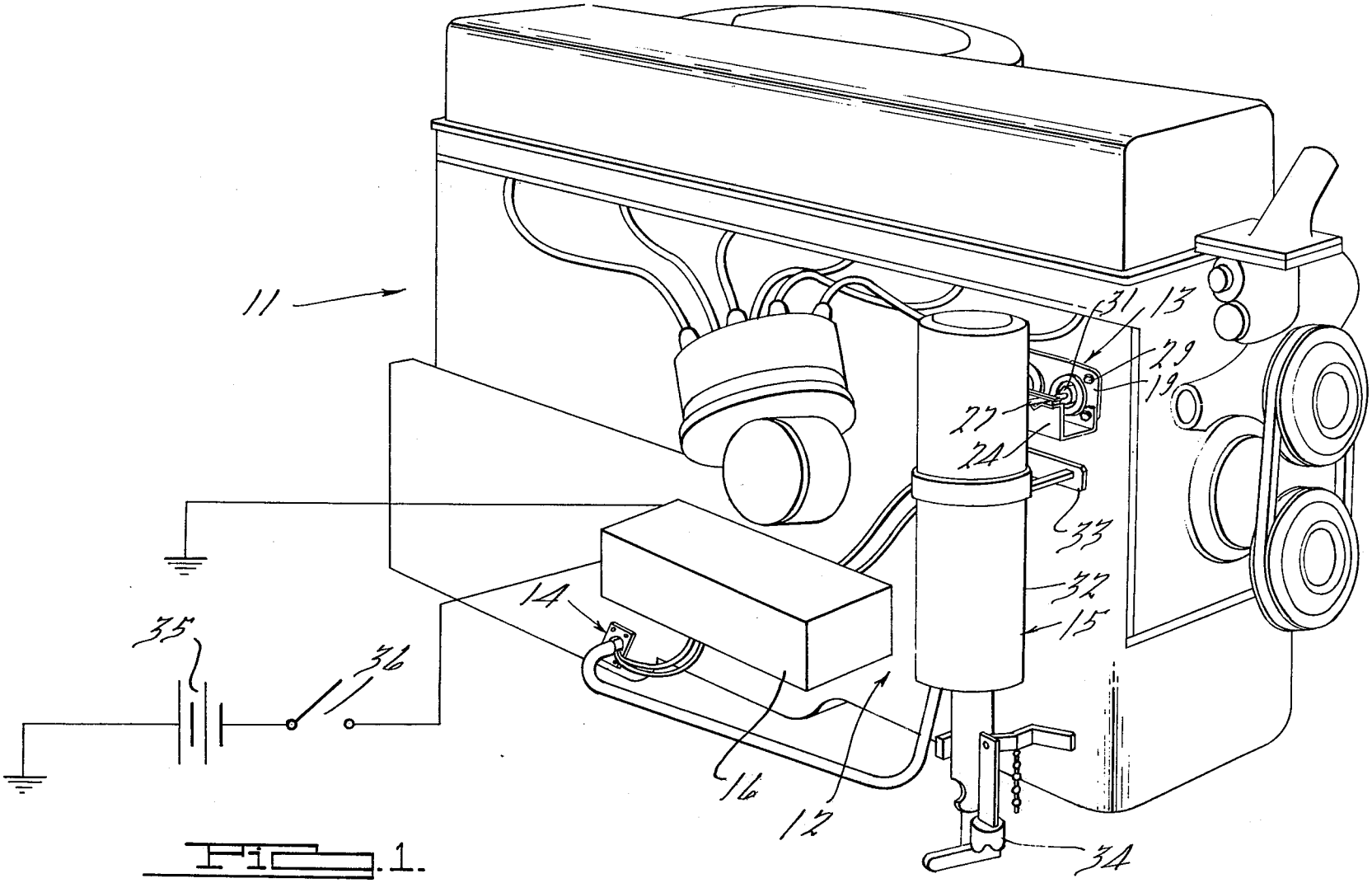
FIG. 1 is a perspective, partially schematic view of an internal combustion engine embodying this invention.

An internal combustion engine embodying this invention is identified generally by the reference numeral 11. The engine 11 may be of any known engine type, such as either a reciprocating or rotary engine, and may be either spark or Diesel ignition. In the illustrated embodiment, the engine 11 is comprised of a water-cooled, six-cylinder, in-line engine.

The engine 11 includes a self-contained engine warmer embodying this invention, which engine warmer is identified generally by the reference numeral 12. The engine warmer 12 is comprised of a water jacket burner assembly 13, an oil pan burner assembly 14, a fuel supply canister 15, and a burner ignition device 16.

Figure 2:
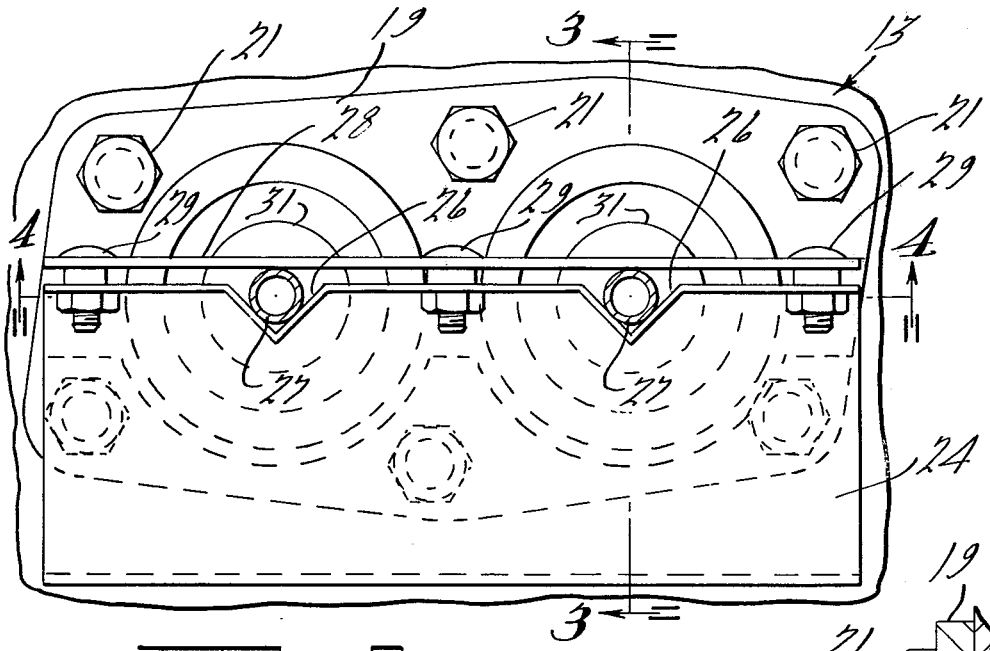
FIG. 2 is an enlarged side elevational view of the burner embodying this invention.
Figure 3:
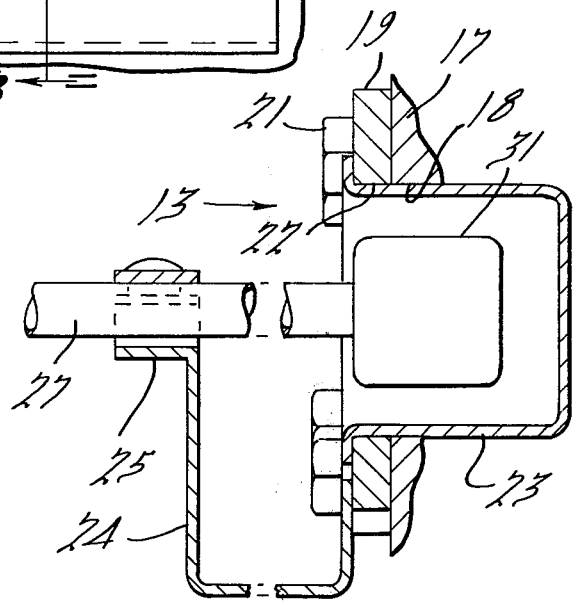
FIG. 3 is a cross sectional view taken along the line 3—3 of FIG. 2.
Figure 4:
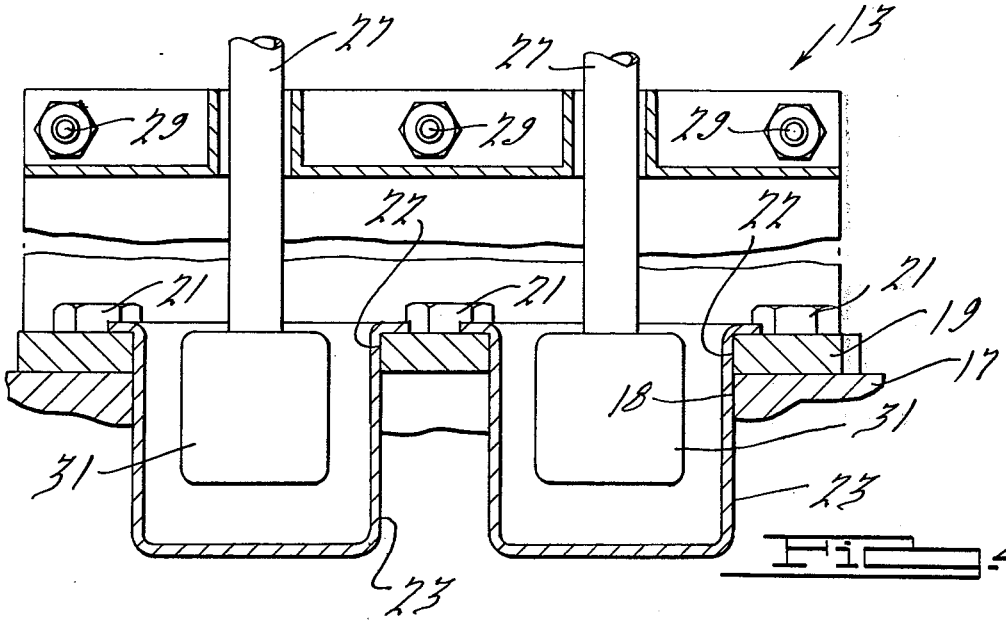
FIG. 4 is a cross sectional view taken along the line 4—4 of FIG. 2.

The construction of the water jacket burner assembly 13 will be described by particular reference to FIGS. 2–4. As is common with many engines, the cylinder block casting has an outer wall 17 in which an opening 18 is formed. The opening 18 is preformed and conventionally is covered by an access plate, or may be specifically designed to accommodate an engine heater.

The burner assembly 13 includes a mounting plate 19 that is adapted to be affixed to the engine block 17 by a plurality of bolts 21. The plate 19 is formed with one or more apertures 22, the number of which may correspond to the number of burner assemblies to be employed. Generally cup-shaped sheet metal stampings 23 extend through the apertures 22 in water-tight relationship therewith. The projections 23 may be formed integrally with a bracket portion 24 that extends outwardly from the wall 17 of the engine block and which forms an outwardly extending flange 25. The flange 25 is formed with a pair of notched recesses 26. Fuel supply pipes 27 are received in the recesses 26 and held in place by a clamping plate 28 and bolt and nut assemblies 29.

Each of the fuel supply pipes 27 extends to a burner assembly 31. The burner assembly 31 is of the infrared type. For example, it may be of the type sold by International Magna Corporation and is adapted to be fueled by propane, butane, or natural gas. The burner 31 is adapted to consume fuel without an open flame as is well known with this type of heater.

Fuel is supplied to the burners 31 via the conduits 27 from the fuel source 17. Fuel source 17 is comprised of a canister 32 that is supported by the engine 11 in any suitable manner, for example by the supporting bracket 33. The fuel canister 32 is adapted to hold a supply of fuel such as LP gas and may be charged selectively by means of a charging valve 34.

The burners 31 are ignited by the ignition device 16, which in turn derives its power from the associated battery, indicated schematically at 35. A switch 36 is provided in the circuit connecting the battery 35 with the ignition device 16. The ignition device 16 may sense the temperature of the engine and operate automatically to maintain a predetermine temperature for the engine. Alternatively, the ignition device 16 may be fired when desired to heat the engine prior to starting. If desired, an external source of electrical power other than the vehicle battery 35 may be employed for operating the ignition device 16. Such alternatives are believed to be readily within the scope of those skilled in this art.

As has already been noted, an oil sump heater 14 is provided in addition to the cooling system heater 13. The oil sump heater 14 may be constructed in a manner similar to the water jacket heater 13. However, in conjunction with heating of the lubricating oil, only one burner need be employed.

It is to be understood that the foregoing description is that of a preferred embodiment of the invention. Various changes and modifications may be made without departing from the spirit and scope of the invention as defined by the appended claims.

I claim:

1. A self-contained heating system for a liquid cooled internal combustion engine having a cooling jacket with an opening formed in an outer wall thereof, said heating system comprising a mounting portion having a flange adapted to engage the cooling jacket outer wall around the opening and a cup-shaped portion extending into the cooling jacket and having a substantial heat radiating area exposed to the coolant therein, a flameless infra-red burner supported by said mounting portion and extending into the interior of said cup-shaped portion for establishing a heat exchange relationship with the coolant, a fuel source for supplying fuel to said flameless infra-red burner, and an electrical ignition system for said burner fired by the battery of the associated engine independent of the vehicle ignition system.

2. The self-contained system as claimed in claim 1 further including another flameless infra-red burner mounted in heat exchanging relationship with the lubricating oil of the associated engine.

* * * * *